US007654874B2

(12) United States Patent
Ader

(10) Patent No.: US 7,654,874 B2
(45) Date of Patent: Feb. 2, 2010

(54) ELECTRICAL CONNECTING DEVICE FOR INSERTING A MALE PLUG CONNECTOR OF AN ELECTRONIC COMPONENT SUCH AS A FUSE OR RELAY

(75) Inventor: Jean-Michel Ader, Roques sur Garonne (FR)

(73) Assignee: Continental Automotive France, Toulouse (FR)

( * ) Notice: Subject to any disclaimer, the term of this patent is extended or adjusted under 35 U.S.C. 154(b) by 71 days.

(21) Appl. No.: 11/795,643

(22) PCT Filed: Aug. 17, 2006

(86) PCT No.: PCT/EP2006/004640

§ 371 (c)(1),
(2), (4) Date: Jul. 19, 2007

(87) PCT Pub. No.: WO2006/122765

PCT Pub. Date: Nov. 23, 2006

(65) Prior Publication Data

US 2008/0146088 A1 Jun. 19, 2008

Related U.S. Application Data

(60) Provisional application No. 60/682,092, filed on May 18, 2005.

(51) Int. Cl.
*H01R 11/22* (2006.01)

(52) U.S. Cl. ..... 439/857; 439/853

(58) Field of Classification Search ..... 439/857, 439/852, 853, 851, 856
See application file for complete search history.

(56) References Cited

U.S. PATENT DOCUMENTS

| | | | | |
|---|---|---|---|---|
| 3,673,551 | A * | 6/1972 | McDonough | 439/853 |
| 4,232,931 | A * | 11/1980 | Takeuchi et al. | 439/857 |
| 4,331,376 | A * | 5/1982 | Leather | 439/689 |
| 4,943,248 | A | 7/1990 | Colleran et al. | |
| 5,062,813 | A * | 11/1991 | Liu et al. | 439/857 |
| 5,989,078 | A | 11/1999 | Chaillot et al. | |
| 6,193,567 | B1 | 2/2001 | Hsieh | |
| 6,814,598 | B2 * | 11/2004 | Hoffmann et al. | 439/249 |
| 7,175,487 | B2 * | 2/2007 | Urbaniak et al. | 439/852 |
| 2004/0038597 | A1 * | 2/2004 | Norris | 439/857 |

FOREIGN PATENT DOCUMENTS

EP 0 356 106 A2 2/1990

* cited by examiner

*Primary Examiner*—Hien Vu
(74) *Attorney, Agent, or Firm*—Young & Thompson

(57) ABSTRACT

An electrical connecting device for inserting a male plug connector of an electronic component, consisting of a strip of electrically conductive material having a central portion with an opening for introducing the male plug connector and, symmetrically on both sides of the central portion, two longitudinal portions each having an intermediate insertion section in which a contact blade is formed which is delimited by a cut-out, and a terminal section for being plugged into a support. The strip of material is folded to form a parallelepiped cage delimited by the central portion and by the two intermediate insertion sections formed so that their contact blades each define a contact area for a male plug connector introduced into the cage, and a section which may be plugged into a support consisting of two terminal sections placed against one another.

17 Claims, 3 Drawing Sheets

Figure 1:
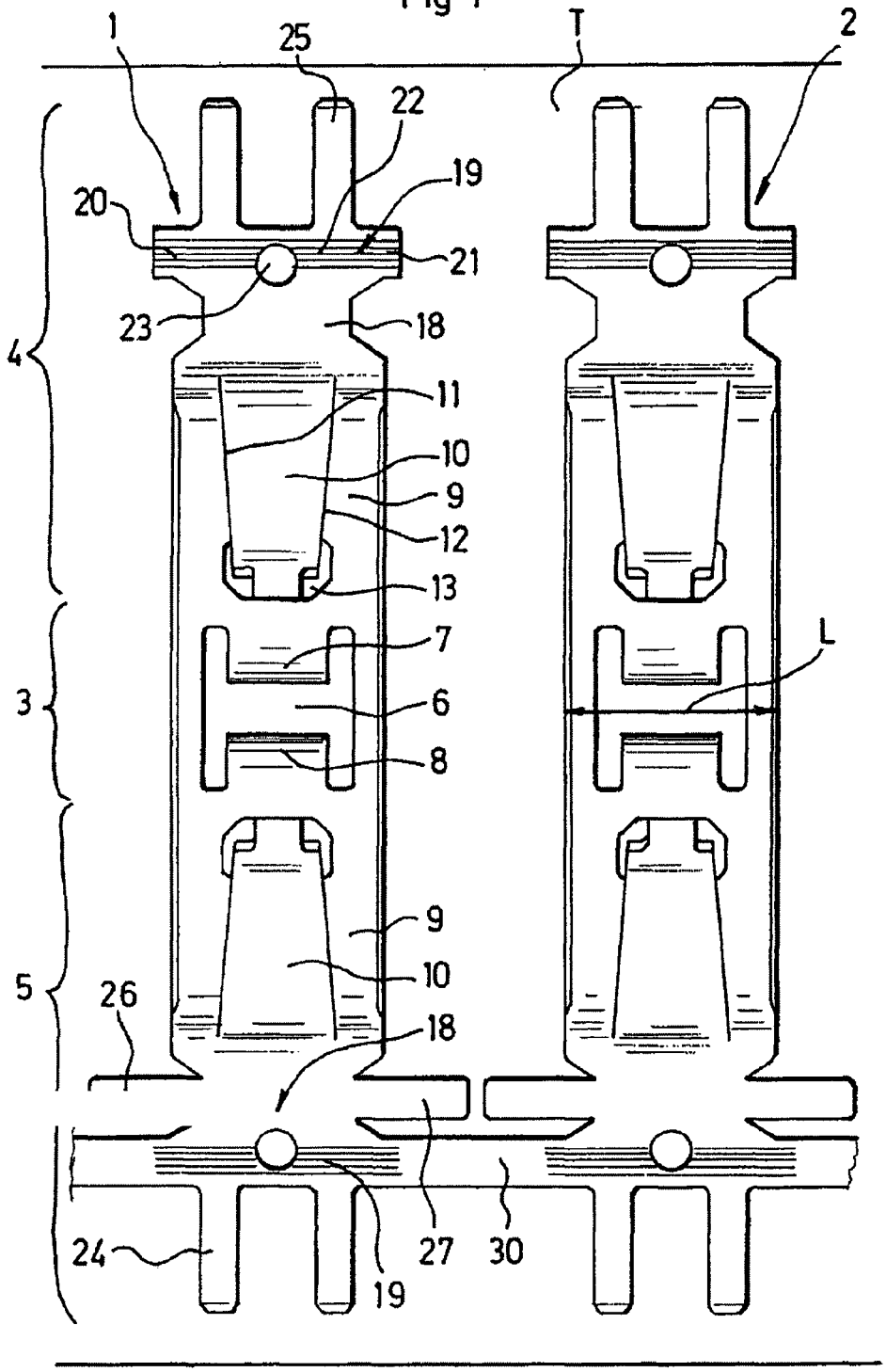

ELECTRICAL CONNECTING DEVICE FOR INSERTING A MALE PLUG CONNECTOR OF AN ELECTRONIC COMPONENT SUCH AS A FUSE OR RELAY

BACKGROUND OF THE INVENTION

1. Field of the Invention

An electrical connecting device is configured for inserting a male plug connector of an electronic component such as a fuse or relay. These connecting devices are particularly suitable for forming connecting elements for the electrical connection of an electronic component on a support such as a printed circuit.

2. Description of the Related Art

Current connecting devices for inserting male plug connectors of electronic components are traditionally made up of metal reinforcements integrated and assembled inside a plastic shell, providing these connecting devices with very good mechanical resistance. Such connecting devices, however, have two significant principal drawbacks. More specifically, each type of connecting device is allocated to a specific electronic component due to the fact that the features (shape of plugs, number of plugs, relative positioning, etc.) of the plug connectors able to be inserted into a plastic shell are fixed. Thus, this design necessitates the production of many different types of connecting devices. Furthermore, such connecting devices have also been shown to have robustness problems leading to faults in the electrical contact.

In order to alleviate these drawbacks, a further solution produced connecting devices without a plastic shell and suitable for allowing the insertion of a single male plug connector. According to this design, the individual connecting devices are arranged and fixed on a support, in quantities and according to a distribution depending on the number and arrangement of plug connectors of the electronic components to be connected to the support.

On the basis of this principle, moreover, a first solution produced "double-material" connecting devices formed from a metal reinforcement, for example made of a copper-based material, arranged inside a ring for inserting a male plug connector, for example made of a steel-based material. Such a design allows the production of connecting devices that have good robustness, both thermal and mechanical. However, it has been shown to lead to relatively high production costs.

A second solution produced "single material" connecting devices made up of a single metal reinforcement, and thus at a cost and price which is considerably lower than that of the "double-material" connecting devices. Nevertheless, such "single material" connecting devices have been shown, however, to have frequent problems with thermal and mechanical robustness.

SUMMARY OF THE INVENTION

The present invention aims to alleviate the aforementioned drawbacks of current connecting devices and has as its main object to provide a "single material" connecting device at an optimized production cost having, furthermore, guaranteed robustness.

A further object of the invention is to provide a connecting device exhibiting excellent thermoelectric behavior.

To this end, the invention relates to an electrical connecting device for inserting a male plug connector of an electronic component such as a fuse or relay, made up of a strip of electrically conductive material having a central portion in which an opening is made for introducing the male plug connector to be inserted and, symmetrically on both sides of said central portion, two longitudinal portions each having an intermediate, so-called insertion, section in which an electrical contact blade is formed which is delimited by a cut-out, and a terminal section for being plugged into a support, said strip being formed so as to have a final state obtained by folding, in which it forms a connecting device, which includes:

- a parallelepiped cage delimited by the central portion of the strip of material forming a front wall for introducing the male plug connector to be inserted, and by the two intermediate insertion sections forming two lateral walls and formed so that their contact blades each have a contact area for a male plug connector introduced into the cage,
- a section which may be plugged into a support consisting of two terminal sections placed against one another, and
- members maintaining the two terminal sections in their relative attached position.

The principle of the invention has, therefore, been to produce a connecting device by folding back onto itself a developed strip, so as to obtain a symmetrical design which has, in particular, a cage for protecting the electrical contact blades, and a pluggable section having a double thickness of material.

This principle of folding back onto itself a developed material which may be carried out directly in the cutting tool, leads, firstly, to an optimized production cost because, on the one hand, it has been shown to lead to a very low consumption of the developed material and, on the other hand, the distance covered by the tool may be considerably reduced.

Furthermore, this principle has been shown to confer considerable mechanical robustness to the connecting device, due in particular:

- to the presence of the parallelepiped cage which offers excellent guidance for the male plug connectors and which has good resistance to the different stresses to which the connecting devices are subjected during the manufacturing process, and subsequently during their lifetime,
- to the robustness of the pluggable section formed of a double thickness of material.

The connecting device according to the invention has been shown, moreover, to have very good thermoelectric behavior due, on the one hand, to its symmetrical shape which leads to a uniform and symmetrical distribution of heat and, on the other hand, to the double thickness and thus to the large profile of the pluggable section.

It is also noteworthy that the connecting devices according to the invention are compatible with all conventional means for mounting connecting devices on a support such as a printed circuit, namely in particular: insertion by force, reflux, wave soldering, and surface mounting.

According to an advantageous embodiment of the invention, the members for maintaining the two terminal sections in their relative attached position include an intermediate assembly section made between the intermediate insertion section and the terminal section of each longitudinal portion, the intermediate assembly sections being suitable for being placed against one another in the final state of the connecting device, and one of said intermediate assembly sections including flaps extending laterally on both sides thereof and suitable for being folded over onto the other intermediate assembly section.

The flaps may be made in one piece with the other elements of the connecting device according to the invention, and provide a very advantageous solution, in terms of production cost, to ensure correct maintenance of the connecting device in its final state.

According to a further advantageous embodiment of the invention, the central portion includes two shoulders made on both sides of the opening and oriented so as to extend inside the cage in order to improve the guidance of the male plug connector. Such guidance constitutes so-called "tamper-resistant" protection, which allows possible damage to the electrical contact blades to be avoided when a male plug connector is introduced into the opening at an angle.

Furthermore, each electrical contact blade has advantageously, according to the invention, the shape of a dihedron provided with a transverse edge defining a contact area for a male plug connector introduced into the cage.

According to a first advantageous variant of the invention, each electrical contact blade is delimited by a U-shaped cut-out, and has a shape suitable for having a free longitudinal end extending by overlapping the solid portion of the corresponding lateral wall of the cage, located in the longitudinal extension of the cut-out.

This shape of the contact blade allows a reduction in the force which has to be exerted in order to insert a male plug connector, while guaranteeing perfect subsequent contact between the male plug connector and the contact blades, due to the stops formed by the lateral walls of the cage which protect against any excessive relative removal, by expansion and/or creep of the contact blades.

Furthermore, each of the U-shaped cut-outs is advantageously made so that the free end of each electrical contact blade extends in the vicinity of the front wall of the cage.

According to this first variant, each electrical contact blade has, moreover, a transverse area of reduced thickness in the vicinity of its free end, so as to increase the flexibility thereof.

According to a second advantageous variant of the invention, each electrical contact blade is delimited by a cut-out consisting of two longitudinal openings surrounding and delimiting longitudinally the electrical contact blade which is thus "embedded" in the region of each of its longitudinal ends.

Furthermore, each intermediate stop section advantageously has a width greater than that of the lateral walls of the cage, suitable for defining a front support surface for a tool for forcibly plugging the connecting device into a support.

Moreover, each intermediate stop section advantageously has longitudinal faces on which transverse grooves are made for avoiding possible rising-up by capillary action of the lacquers usually covering the supports, such as printed circuits.

Each intermediate stop section is also advantageously perforated by a central through-orifice extending between the longitudinal faces of the section, for mechanically driving the sheet of material on the production tool, and for forming, subsequently, a receptacle for collecting the aforementioned lacquer.

According to a further advantageous embodiment, each terminal section is formed from two parallel longitudinal pins.

BRIEF DESCRIPTION OF THE DRAWING FIGURES

Figure 2:
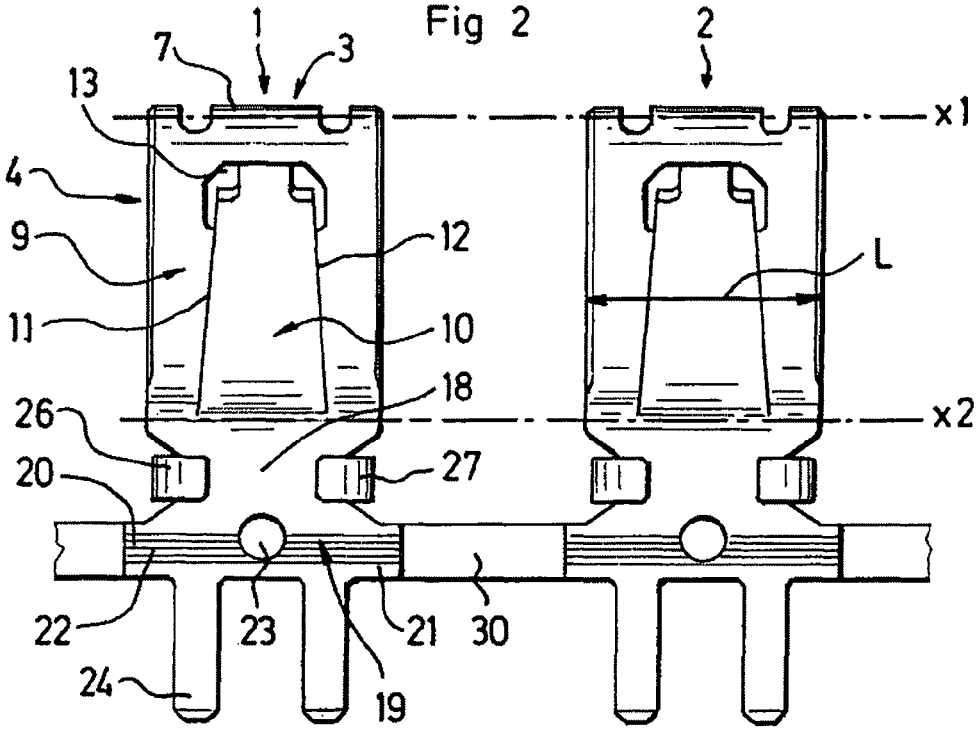
Figure 3:
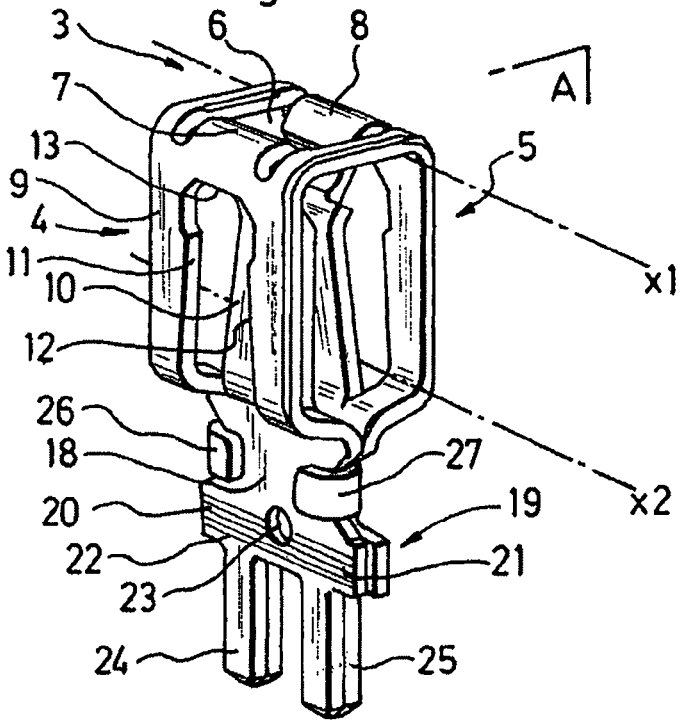
Figure 4:
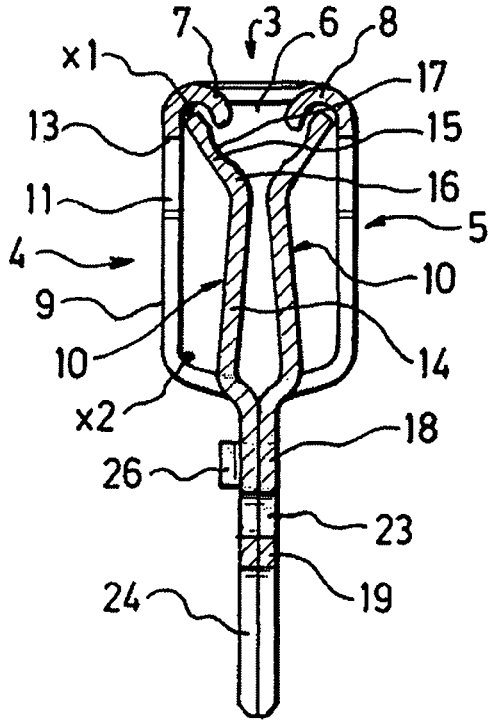
Figure 5:
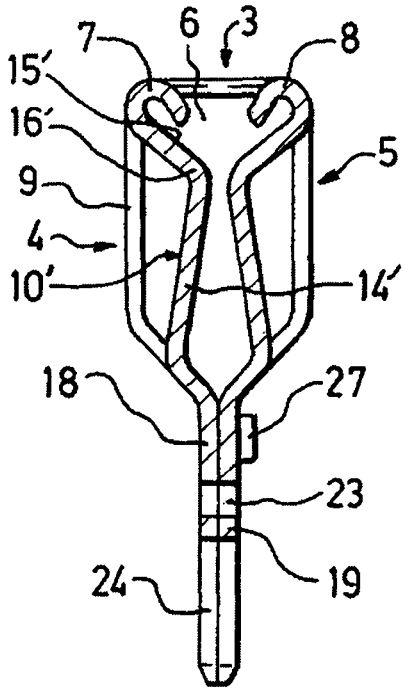

Further features, objects and advantages of the invention will become apparent from the detailed description which follows by referring to the accompanying drawings which represent by way of non-limiting examples two preferred embodiments thereof, in which:

FIG. 1 is a partial plan view of a plate on which two impressions of connecting devices according to the invention are made, FIG. 2 is a front view of these connecting devices after cutting out the impressions and folding the impressions, FIG. 3 is a perspective view of one of the connecting devices of FIGS. 1 and 2, FIG. 4 is a longitudinal section through a plane A of this connecting device, and FIG. 5 is a longitudinal section similar to that of FIG. 4, showing a variant of the connecting device according to the invention.

DETAILED DESCRIPTION OF THE INVENTION

The connecting devices shown in the drawing figures are suitable for housing a male plug connector of an electronic component such as a fuse or relay and for ensuring an electrical connection between this electronic component and a printed circuit track.

As shown in FIG. 1, these connecting devices are firstly made by stamping out impressions (two in FIG. 1) in a plate T made of a conductive material such as a copper alloy.

As shown in this FIG. 1, each impression is a strip of material of standard width L and having a central portion 3 in which a transverse opening 6 is made which is delimited by two shoulders 7, 8 having a curved section for guiding a male plug connector when introduced into the opening 6.

This strip of material has, symmetrically on both sides of the central portion 3, two longitudinal portions 4, 5 each successively having, starting from the central portion:

- an intermediate, so-called insertion, section 9, in which an electrical contact blade 10 is formed, which is delimited by a U-shaped cut-out 11-13,
- an intermediate assembly section 18 of a width less than the standard width L,
- an intermediate stop section 19 of a width greater than the standard width L, and
- a terminal pluggable section 24, 25 formed from (in the example shown) of two parallel longitudinal pins. It is noteworthy, however, that the pluggable sections may have, as a variant, a single pin or more than two pins.

According to the embodiment shown in FIGS. 1 to 4, the cut-out made in each intermediate insertion section 9 has a U-shaped cut-out formed by two longitudinal openings 11, 12 obtained by cutting and a transverse opening 13 formed by cutting out. Moreover, this U-shaped cut-out is made so that the transverse opening 13 extends in the vicinity of the central portion 3.

Each electrical contact blade 10 is delimited by a cut-out 11-13 in each intermediate insertion section 9 and has the shape of a dihedron having two faces 14, 15 (FIG. 4) of unequal length extending on both sides of a transverse edge 16. A face 15 of shorter length forms the free end portion of the contact blade 10 and thus extending in the vicinity of the central portion 3, and a face 14 of greater length "embedded" in the region of its longitudinal end opposing the transverse edge 16.

Furthermore, the face 15 has a transverse area 17 of reduced thickness suitable for increasing the flexibility of the free end section of each contact blade 10.

Each intermediate assembly section 18 (FIG. 1), itself, extends in the immediate extension of an intermediate insertion section 9. Moreover, one of these intermediate assembly sections 18 includes two lateral flaps 26, 27 extending laterally on both sides thereof, which are configured for being folded back onto the other intermediate assembly section 18 into a relative attached position of the intermediate assembly sections 18.

It is noteworthy that, in order to reduce the distance covered by the tool and as a variant, the flaps 26, 27 may be arranged alternatively on the intermediate assembly sections 18 of one, and then of the other, longitudinal portion 4, 5 of two adjacent impressions.

Each intermediate stop section 19 is finally made in the direct extension of an intermediate assembly section 18, and has, as mentioned above, a width greater than L suitable for forming two lateral fins 20, 21. The fins 20, 21 define a front support surface for a tool in the region of its joint with the intermediate assembly section 18, for forcibly plugging the connecting device into a support.

It is noteworthy, moreover, that the intermediate stop sections 19 also have a front stop surface able to be used for limiting the penetration of the connecting device in the region of their joint with the parallel longitudinal pins forming the terminal sections 24, 25.

Furthermore, each intermediate stop section 19 has longitudinal faces on which transverse grooves 22 are made for avoiding the possible rising-up of lacquer by capillary action.

These longitudinal faces are also perforated by a central through-orifice 23 (FIG. 3) for mechanically driving the plate T on the production tool and for forming, subsequently, a receptacle for collecting lacquer.

As shown in FIG. 1, the impressions 1, 2 formed in the plate T are connected to one another by a divisible connection 30. The divisible connection 30 extends between the longitudinal portions 5 of the impressions and connect, in a divisible manner, the intermediate stop sections 19 of the longitudinal portions.

After cutting out from the plate T, these impressions 1, 2 are then folded to obtain the connecting devices shown in FIG. 2 before the breaking of the divisible connection 30. FIG. 3 shows a connecting device after breaking this connection.

The folds are formed by folding back each longitudinal portion 4, 5 about the two transverse axes x1, x2 extending in the region of each of the longitudinal ends of the intermediate insertion sections 9, so as to:

produce a parallelepiped cage delimited by the central portion 3 forming a front wall for introducing the male plug connector to be inserted, and the two intermediate insertion sections 9 form two lateral walls so that the transverse edges 16 of their contact blades 10 each form a contact area for a male plug connector introduced into the cage, and place the intermediate assembly sections 18, the intermediate stop sections 19 and the pluggable sections 24, 25, respectively, of the two longitudinal portions 4, 5 against one another.

Furthermore, as shown in particular in FIG. 4, the contact blades 10 have a free longitudinal end extending by overlapping the solid portion of the corresponding lateral wall 9 of the cage, located in the longitudinal extension of the cut-out 11-13.

In this manner, the free ends of the contact blades 10 bear slidably against the lateral wall 9 relative to the cage.

The final step for producing the connecting devices includes folding back the flaps 26, 27 so as to prevent any subsequent "opening" of the cage.

The connecting device shown in FIG. 5 differs from that disclosed above in that its contact blades 10' are "embedded" in the region of each of their longitudinal ends and each delimited, to this end, by a cut-out consisting of two longitudinal openings 11, 12 surrounding the contact blade 10'.

The invention claimed is:

1. A female electrical connecting device for inserting a male connector, comprising:

a strip of electrically conductive material having a central portion (3) in which an opening (6) with two shoulders (7,8) is made for introducing the male plug connector to be inserted and, symmetrically on both sides of said central portion;

two longitudinal portions (4, 5) of the strip symmetrically located at each side of the central portion, each longitudinal portion comprising an intermediate insertion section (9) in which an electrical contact blade (10; 10') is formed;

a cut-out (11-13; 11, 12) delimiting the electrical contact blade; and two terminal sections (24, 25) configured to be spaced apart for being plugged into a support, wherein the strip is folded to form:

a parallelepiped cage with the central portion (3) of the strip of material forming a perforated front wall for receiving the male plug connector, the opening (6) being delimited by the two shoulders (7, 8) and having a curved section adapted for guiding the male plug connector, the two intermediate insertion sections (9) and aligned with the two terminal sections and forming two lateral walls with their contact blades (10; 10') each comprising a contact area for a male plug connector introduced into the cage, and members (18, 26, 27) for maintaining the two terminal sections (24, 25) in their relative attached position, the members for maintaining the two terminal sections (24, 25) in their relative attached position comprising intermediate assembly sections (18) made between the intermediate insertion section (9) and the terminal section (24, 25) of each longitudinal portion (4, 5), said intermediate assembly sections being adapted for being placed against one another, and one of said intermediate assembly sections comprising flaps (26, 27) extending laterally on both sides thereof and configured for being folded over onto the other intermediate assembly section (18).

2. The connecting device as claimed in claim 1, wherein each electrical contact blade (10) is delimited by a U-shaped cut-out (11-13) and has a shape suitable for having a free longitudinal end extending by overlapping a solid portion of the corresponding lateral wall (9) of the cage, located in a longitudinal extension of the cut-out (11-13).

3. The connecting device as claimed in claim 2, wherein each cut-out (11-13) is configured so that the free end of each electrical contact blade (10) extends in a vicinity of a front wall of the cage formed from the central portion (3).

4. The connecting device as claimed in claim 2, wherein each electrical contact blade (10) has a transverse area (17) of reduced thickness in the vicinity of its free end.

5. The connecting device as claimed in claim 1, wherein each electrical contact blade (10') is delimited by a cut-out formed from two longitudinal openings (11, 12) surrounding and delimiting longitudinally the electrical contact blade.

6. The connecting device as claimed in claim 1, wherein each terminal section comprises two parallel longitudinal pins.

7. The connecting device as claimed in claim 1, wherein each electrical contact blade (10) is delimited by a U-shaped cut-out (11-13) and has a shape configured for having a free longitudinal end extending by overlapping a solid portion of the corresponding lateral wall (9) of the cage, located in a longitudinal extension of the cut-out (11-13).

8. The connecting device as claimed in claim 3, wherein each electrical contact blade (10) has a transverse area (17) of reduced thickness in a vicinity of its free end.

9. The connecting device as claimed in claim 1, wherein each electrical contact blade (10') is delimited by a cut-out having two longitudinal openings (11, 12) surrounding and delimiting longitudinally the electrical contact blade.

10. The connecting device as claimed in claim 1, wherein the intermediate stop sections (19) have a width greater than that of the lateral walls (9) of the cage, which define a front support surface for a tool for forcibly plugging the connecting device into a support.

11. A female electrical connecting device for inserting a male connector, comprising:

a strip of electrically conductive material having a central portion (3) in which an opening (6) with two shoulders (7,8) is made for introducing the male plug connector to be inserted and, symmetrically on both sides of said central portion;

two longitudinal portions (4, 5) of the strip symmetrically located at each side of the central portion, each longitudinal portion comprising an intermediate insertion section (9) in which an electrical contact blade (10; 10') is formed;

a cut-out (11-13; 11, 12) delimiting the electrical contact blade; and two terminal sections (24, 25) configured to be spaced apart for being plugged into a support, wherein the strip is folded to form:

a parallelepiped cage with the central portion (3) of the strip of material forming a perforated front wall for receiving the male plug connector, the opening (6) being delimited by the two shoulders (7, 8) and having a curved section adapted for guiding the male plug connector, the two intermediate insertion sections (9) and aligned with the two terminal sections and forming two lateral walls with their contact blades (10; 10') each comprising a contact area for a male plug connector introduced into the cage, and members (18, 26, 27) for maintaining the two terminal sections (24, 25) in their relative attached position, wherein intermediate stop sections (19) have a width greater than that of the lateral walls of the cage formed from the two intermediate insertion sections (9), which define a front support surface for a tool for forcibly plugging the connecting device into a support, and each intermediate stop section (19) has longitudinal faces on which transverse grooves (22) are made.

12. The connecting device as claimed in claim 11, wherein each intermediate stop section (19) is perforated by a central through-orifice (23) extending between the longitudinal faces of said stop section.

13. A female electrical connecting device for inserting a male plug connector, comprising:

a strip of electrically conductive material having a central portion (3) in which an opening (6) is made for introducing the male plug connector to be inserted and, symmetrically on both sides of said central portion;

two longitudinal portions (4, 5) of the strip symmetrically located at each side of the central portion, each longitudinal portion comprising an intermediate insertion section (9), in which an electrical contact blade (10; 10');

a cut-out (11-13; 11, 12) delimiting the electrical contact blade;

intermediate stop sections (19) have a width greater than that of the lateral walls of the cage formed from the two intermediate insertion sections (9), which define a front support surface for a tool for forcibly plugging the connecting device into a support, each intermediate stop section (19) having longitudinal faces on which transverse grooves (22) are made, each intermediate stop section (19) is perforated by a central through-orifice (23) extending between the longitudinal faces of said stop section; and a terminal section (24, 25) configured to be spaced apart for being plugged into a support, wherein the strip is folded to form:

a parallelepiped cage with the central portion (3) of the strip of material forming a perforated front wall for introducing the male plug connector to be inserted, the two intermediate insertion sections (9) and aligned with the two terminal sections and forming two lateral walls with their contact blades (10; 10') each comprising a contact area for a male plug connector introduced into the cage, a section configured to be plugged into a support, the section comprising at least two terminal sections (24, 25) placed against one another, and and members (18, 26, 27) maintaining two terminal sections (24, 25) in their relative attached position.

14. The connecting device as claimed in claim 13, wherein the members for maintaining the two terminal sections (24, 25) in their relative attached position comprise an intermediate assembly section (18) made between the intermediate insertion section (9) and the terminal section (24, 25) of each longitudinal portion (4, 5), said intermediate assembly sections being adapted for being placed against one another, and one of said intermediate assembly sections comprising flaps (26, 27) extending laterally on both sides thereof and configured for being folded over onto the other intermediate assembly section (18).

15. The connecting device as claimed in claim 13, wherein each electrical contact blade (10) is delimited by a U-shaped cut-out (11-13) and has a shape suitable for having a free longitudinal end extending by overlapping a solid portion of the corresponding lateral wall (9) of the cage, located in a longitudinal extension of the cut-out (11-13).

16. The connecting device as claimed in claim 15, wherein each cut-out (11-13) is configured so that the free end of each electrical contact blade (10) extends in a vicinity of a front wall of the cage formed from the central portion (3).

17. A plate containing an impression of a connection device, comprising:

a female electrical connecting device for receiving a male plug connector, comprising:

a strip of electrically conductive material having a central portion (3) in which an opening (6) with two shoulders (7,8) is made for introducing the male plug connector to be inserted and, symmetrically on both sides of said central portion;

two longitudinal portions (4, 5) of the strip symmetrically located at each side of the central portion, each longitudinal portion comprising an intermediate insertion section (9), in which an electrical contact blade (10; 10');

a cut-out (11-13; 11, 12) delimiting the electrical contact blade;

intermediate stop sections (19) have a width greater than that of the lateral walls of the cage formed from the two intermediate insertion sections (9), which define a front support surface for a tool for forcibly plugging the connecting device into a support, each intermediate stop section (19) having longitudinal faces on which transverse grooves (22) are made, each intermediate stop section (19) is perforated by a central through-orifice (23) extending between the longitudinal faces of said stop section; and terminal sections (24, 25) aligned with the two terminal stop sections and configured to be spaced apart for being plugged into a support.

* * * * *